US007137578B2

(12) United States Patent
Steingass et al.

(10) Patent No.: US 7,137,578 B2
(45) Date of Patent: Nov. 21, 2006

(54) SEGMENTED MONITOR

(75) Inventors: Robert W. Steingass, Valparaiso, IN (US); David J. Kolacz, Plymouth, IN (US)

(73) Assignee: Task Force Tips, Inc., Valparaiso, IN (US)

( * ) Notice: Subject to any disclaimer, the term of this patent is extended or adjusted under 35 U.S.C. 154(b) by 206 days.

(21) Appl. No.: 10/746,102

(22) Filed: Dec. 26, 2003

(65) Prior Publication Data

US 2005/0145727 A1 Jul. 7, 2005

(51) Int. Cl.
*B05B 15/08* (2006.01)

(52) U.S. Cl. ..... 239/587.2; 239/166; 239/587.1; 239/587.6; 169/24; 285/181; 285/147.1; 285/147.3; 285/912

(58) Field of Classification Search ..... 285/181, 285/912, 147.1, 147.3; 239/588, 587.1, 587.2, 239/106, 587.6, 24, 166; 169/51, 54, 25
See application file for complete search history.

(56) References Cited

U.S. PATENT DOCUMENTS

| | | | | |
|---|---|---|---|---|
| 557,799 | A | 4/1896 | Gorter | |
| 2,612,402 | A * | 9/1952 | Miscovich | 239/587.2 |
| 3,498,325 | A * | 3/1970 | Ashton et al. | 137/615 |
| 4,392,618 | A | 7/1983 | Evans et al. | 239/461 |
| 4,506,738 | A | 3/1985 | Evans et al. | 169/24 |
| 4,607,702 | A | 8/1986 | Miller | 169/25 |
| 4,674,686 | A | 6/1987 | Trapp | 239/279 |
| 4,679,732 | A | 7/1987 | Woodward | 239/265.35 |
| 4,793,557 | A | 12/1988 | Marchese et al. | 239/587 |
| 4,913,354 | A | 4/1990 | Woodward | 239/265.35 |
| 4,990,050 | A | 2/1991 | Tsuge et al. | 414/735 |
| 5,297,443 | A | 3/1994 | Wentz | 446/27 |
| 6,109,360 | A | 8/2000 | Mandzukic et al. | 169/51 |
| 6,305,620 | B1 * | 10/2001 | Marchese | 239/587.1 |
| 6,354,320 | B1 | 3/2002 | Kolacz et al. | 137/38 |
| 6,550,817 | B1 * | 4/2003 | Mitchell | 285/147.1 |
| D479,314 | S | 9/2003 | Trapp | D23/264 |
| 6,655,613 | B1 * | 12/2003 | Brown | 239/587.1 |

* cited by examiner

*Primary Examiner*—David A. Scherbel
*Assistant Examiner*—Jason Boeckmann
(74) *Attorney, Agent, or Firm*—John H. Person, Jr., Esq.; Walter F. Dawson, Esq.; Pearson & Pearson, LLP.

(57) ABSTRACT

A firefighting segmented monitor for redirecting a trajectory of a pressurized fluid discharge towards a target comprises a flowpath with minimum convolutions. The monitor flowpath comprises in series a stationary segment and three rotating segments including a lower segment, a middle segment and an upper segment connected in series each of which comprises a predetermined curvature. The lower segment swivels in one axis about the stationary segment. A nonorthogonal swivel is arranged on each end of the middle segment at the interfaces with the lower segment and the upper segment, and the swiveling of the middle and upper segments are synchronized with a single rotary input to produce an approximately planar elevational motion of the fluid discharge end of the monitor.

43 Claims, 13 Drawing Sheets

SEGMENTED MONITOR

BACKGROUND OF THE INVENTION

1. Field of the Invention

This invention relates generally to firefighting monitors and in particular to a compact segmented monitor having three nonorthogonal swivel joints, and minimal convolutions in the flowpath to reduce fluid pressure loss and to reduce overall turbulence of a discharge stream exiting from the segmented monitor.

2. Description of Related Art

A firefighting monitor is a conduit that is supplied with a pressurized fluid (usually water) at the inlet end and has a fire-fighting nozzle connected at the discharge end. The firefighting monitor's primary purpose is to allow the fluid exiting the nozzle to be redirected in both elevation and azimuth angles and then remain pointed at the desired target.

Monitors may be installed in fixed locations, may be portable devices, or may be mounted on mobile equipment such as fire trucks, trailers, and the like. Monitors in the fire service are generally fitted with a nozzle on their discharge whose purpose it is to increase the velocity of the jet and form a spray of a desired type or shape. The most common purpose of the monitor is the delivery of a straight stream over considerable distances. The usefulness of the stream is a function of the turbulence in the monitor itself.

Monitors have been classified into three basic types as follows: spherical ball-in-socket designs, bending of a flexible hose, and mutually perpendicular swivel joints. Most ball-in-socket designs develop motion through a sliding motion between the ball and socket, thus tending to have high friction to overcome. A single ball-in-socket is restricted to travels substantially less than 90 degrees from straight which limits their usefulness. Ball-in-socket devices arranged in a series allow a wider range of motion. The position of the ball joints are retained by friction alone. However, reaction forces on ball joints arranged in a series cause position to be unstable when the centerline of the nozzle reaction force does not pass through the centers of rotation.

U.S. Pat. No. 557,799 issued Apr. 7, 1896 to H. H. Gorter discloses an adjustable nozzle for hose pipes comprising in series a first curved section and a second curved section having an upper end which is a hollow semiglobular enlargement to which a nozzle is connected. The nozzle has a semiglobular enlargement which fits over the enlargement end of the second curved section and is secured to it by a trunion on each side thus forming a pivoted ball-and-socket joint.

U.S. Pat. No. 4,506,738 issued Mar. 26, 1985 to John L. Evans, et al. and assigned to Chubb Fire Security Limited of Sanbury-on-Thames, England, discloses a spherical head type liquid-projecting monitor comprising a head and housing which together define a chamber from which water is led through an inlet in the rear of the head to a passage extending through the head. The head has a frusto-spherical external surface which forms a sliding seal against an O-ring to keep the chamber watertight throughout the permitted range of pivotal movement of the head relative to the housing. The cross-sectional area of the passage within the head is approximately constant throughout its length to reduce turbulence and pressure drop. However, the axle passing through the flowpath presents a disruption to the flow causing turbulence while the ball in socket arrangement is limited to relatively limited range of motion.

U.S. Pat. No. 6,305,620 issued Oct. 23, 2001 to Antonio B. Marchese discloses a firefighting monitor having a plurality of outlet arms extending from the main inlet pipe. A main rotary joint is provided for rotating the casing and the plurality of outlet arms. Each outlet arm has an outlet rotary joint. A swiveling nozzle is coupled to each outlet arm for directing water from each outlet arm separately. Each swiveling nozzle has a ball joint having a passageway therethrough and having a handle thereon for rotating the main inlet pipe and the plurality of outlet nozzles. The main rotary joint and outlet arm rotary joint have an annular rack gear engaging a worm gear. When the outlet arm is rotated, the nozzles are rotated for vertical adjustment of the spray. However, the ball joints would be difficult to move under pressure because of the sliding motion of the ball within their sockets. In addition, the rotating joints would be difficult to move because of the eccentric loading of the nozzle reaction forces on the rotating joints.

U.S. Pat. No. 5,297,443 issued Mar. 20, 1994 to John D. Wentz discloses flexible positioning by bending a flexible hose. While the number of bends and turbulence in the flow path are minimized, in all cases the support for managing the hose relies on an external structural mechanism. This mechanism must withstand the forces of nozzle reaction, and in some cases the internal pressure of the hose itself. In addition, flexible hoses are limited by compression set properties of the flexible hose material. Adverse stresses exist within the hose for all positions other than neutral, which limits their degree of flexibility, and optimal storage position.

Because of their limitations, the use of the ball in socket devices and flexible hose mechanisms accounts for only a small percentage of the actual number of monitors commercially produced each year.

Monitors with mutually perpendicular swivel joints for use in firefighting account for the vast majority of monitors. These have been constructed with single or with twin waterways of various designs. The motion is controlled by swiveling the monitor through two mutually perpendicular axes. The line of action of the discharge trajectory is generally designed to pass substantially through both axes of rotation such that the reaction forces of the discharged fluids do not create a rotational moment on the monitor's swivel joint. Controlling the motion of the swivel joints with simple worm gear or other mechanisms are known in the art.

Monitors for use on the deck of fire trucks at flows up to 2000 GPM typically use a single waterway design. The most compact of these is the Stream Master® manufactured by Akron Brass of Wooster, Ohio. In the Stream Master® the water enters from a vertical feed pipe into the monitor, and undergoes approximately 3 bends of 90 degrees each. From here it enters the exit section where it undergoes 3 additional 90 degree bends. The water undergoes a total of 540 degrees of convolutions. Because compactness in mobile equipment design is desirable, the form of the bends in this monitor have been optimized as flattened shapes with essentially a zero inside elbow bend radius. It is doubtful that the flow area in these bends is equal to the flow area of the 4" inlet diameter. With such an ultra contorted flow path these bends produce severe turbulence which adversely effect friction loss, stream quality and range.

Other prior art monitors are known and described in the following U.S. patents:

In U.S. Pat. No. 6,109,360 issued Aug. 29, 2000 to Thomas Mandzukia and assigned to Premier Farnell Corp. of Cleveland, Ohio, a firefighting monitor is disclosed having a rotatable extension member for adjusting the elevation of an outlet attached to the extension member while maintaining the discharge direction. Both the extension member and the outlet member are independently rotatable through an arc of at least 135 degrees in one direction from the vertical. However, this monitor has mutually perpendicular swivel joints in the same general shape and amount of convolutions in the water way as the Stream Master® of Akron Brass above.

In U.S. Pat. No. 4,674,686 issued Jun. 23, 1987 to James M. Trapp and assigned to Elkhart Brass Manufacturing Co., of Elkhart, Ind., a portable fire apparatus monitor is disclosed comprising a snap-fitting latch pin which fits beneath a swivel bearing on the monitor mount and which secures the monitor in place during firefighting operation and provides for quick connection to and disconnection from the mount. The flow path of this monitor comprises a plurality of turns which create undesirable turbulence and friction losses.

Therefore, it is desirable to have a monitor that has compact size with wide range of motion and minimal convolutions within the flowpath to minimize turbulence and friction losses.

SUMMARY OF THE INVENTION

Accordingly, it is therefore an object of this invention to provide a single flowpath firefighting monitor having positionable segments that swivel about an axis of rotation for a wide range of motion with a minimum number of convolutions in the flowpath.

It is another object of this invention to provide a segmented monitor having a stationary segment and three adjustable segments for forming a range of discharge elevation directions from being parallel with the inlet fluid direction to a discharge direction that has a maximum angular displacement of 136 degrees from the inlet fluid direction, and also adjustable to any azimuth direction.

It is another object of this invention to provide a segmented monitor having approximately planar motion of the discharge stream during elevation adjustments of the monitor.

It is a further object of this invention to provide a segmented monitor with a controlling mechanism that is substantially free from restraining forces resulting from internal pressure or nozzle reaction.

It is another object of this invention to provide a compact monitor with minimum turbulence and friction losses to produce a discharge stream which reaches a greater distance.

It is yet another object of this invention to synchronize the equal and opposite rotation of two of the segments using a single device mechanism.

These and other objects are accomplished by a firefighting monitor for redirecting a flow of fluid from a pressurized fluid source through a conduit, the conduit comprising four consecutive segments rotatably connected in series wherein an axis of rotation is provided at each connection between the four segments. The conduit comprises a first segment connected to the fluid source followed in series by a second segment connected to an outlet of the first segment, a third segment connected to an outlet of the second segment and a fourth segment connected to an outlet of the third segment forming consecutively at each connection a first axis of rotation, a second axis of rotation and a third axis of rotation respectively; the monitor includes a redirection of an azimuth angle of the conduit by an azimuth rotation between the first segment and the second segment on the first axis of rotation, and the monitor further includes a redirection of an elevation angle of the conduit by a first rotation between the second segment and the third segment on the second axis of rotation in a first direction and by a second rotation between the third segment and the fourth segment on the third axis of rotation in an opposite direction to the first direction. The fourth segment comprises a discharge end having a discharge centerline which intersects with a centerline of the second axis of rotation and a centerline of the third axis of rotation, thereby minimizing rotational torque on the connection between the second segment and the third segment and the rotational torque on the connection between the third segment and the fourth segment.

The redirection of an elevation angle of the monitor includes a synchronization of the first rotation between the second segment and the third segment and the second rotation between the third segment and the fourth segment in counter rotating directions to obtain approximately planar motion of the discharge centerline during the elevation angle redirection. The fourth segment comprises a discharge end having a discharge centerline that is approximately coplaner with the first axis of rotation thereby minimizing rotational torque on the connection between the first segment and the second segment. The monitor comprises an angle of approximately 68 degrees between the first axis of rotation and the second axis of rotation, an angle of approximately 34 degrees between the second axis of rotation and the third axis of rotation, and an angle of approximately 34 degrees between the third axis of rotation and the discharge centerline. The monitor comprises an angle between the second axis of rotation and the third axis of rotation and a substantially equal angle between the third axis of rotation and the discharge centerline. The second segment comprises a predetermined curvature adjacent to an outlet end, the third segment comprises a predetermined curvature between an inlet end and the outlet end, and the fourth segment comprises a first curvature extending from an inlet end and a second curvature extending to an outlet end of the fourth segment. The fourth segment comprises the first curvature and the second curvature to minimize rotational torque on the connection between the first segment and the second segment. The predetermined curvature of the second segment comprises approximately 68 degrees, the predetermined curvature of the third segment comprises approximately 34 degrees, and the first curvature of the fourth segment comprises approximately 73 degrees and the second curvature of the fourth curvature comprises approximately 39 degrees. At least one of the rotatable connections comprises a male/female ball race. The first segment is rotatably connected to the second segment by a first male/female ball race, the second segment is rotatably connected to the third segment by a second male/female ball race, and the third segment is rotatably connected to the fourth segment by a third male/female ball race. The second segment comprises an azimuth shaft assembly connected to a first turning device for adjusting the azimuth rotation, and the azimuth shaft assembly comprises a worm for engaging a worm wheel located on the circumference of the first segment. The synchronization comprises gears. The gears comprise bevel gears.

The redirection of an elevation angle of the conduit comprises a first ring gear rotatably connected on an inlet end of the third segment, a second ring gear attached to an inlet end of the fourth segment, the second ring gear engaging the first ring gear at a predetermined angle, a half-ring gear attached to an outer receiving surface of the third segment, and a pinion, rotatably connected on a side of the second segment adjacent to the first ring gear and the half-ring gear, comprising a bevel gear for driving the first ring gear and the half-ring gear in opposite directions. The conduit further comprises an elevation shaft assembly having an end connected to a second turning device for adjusting the elevation angle, and the pinion comprises a worm wheel for engaging with a worm of the elevation shaft assembly for changing the elevation angle in response to the second turning device. The first ring gear and the second ring gear engage each other at an angle substantially equal to an angle between the second axis of rotation and the third axis of rotation.

The objects are further accomplished by a firefighting monitor for redirecting a flow of fluid from a pressurized fluid source through a conduit comprising a stationary segment connected to the fluid source, a lower segment of the conduit having a predetermined curvature between an inlet end and an outlet end, the inlet end being rotatably connected to the stationary segment, the lower segment including means for enabling azimuth rotation of the monitor, a middle segment of the conduit having a predetermined curvature between an inlet end and an outlet end, the middle segment being rotatably connected to the lower segment, an upper segment of the conduit having a first curvature extending from an inlet end and a second curvature extending to an outlet end of the upper segment, the upper segment being rotatably connected to the middle segment, and means for performing an elevation positioning of the monitor by synchronizing the simultaneous rotation of the upper segment and the middle segment in opposite directions with respect to the lower segment. The means for enabling azimuth rotation of the monitor includes the lower segment rotating about a cylindrical portion of the stationary segment. The means for providing azimuth rotation of the monitor comprises an azimuth shaft assembly connected to a first turning device. The azimuth shaft assembly comprises a worm for engaging a worm wheel located on the circumference of the stationary segment. The predetermined curvature of the lower segment of the conduit comprises a curvature of approximately 68 degrees. The predetermined curvature of the middle segment of the conduit comprises a curvature of approximately 34 degrees. The means for rotatably connecting the middle segment to the lower segment comprises a male/female ball race. The first curvature extending a predetermined distance from an inlet end of the upper segment of the conduit comprises a curvature of approximately 73 degrees. The second curvature of the upper segment extending over a predetermined distance from the first curvature distance to an outlet end comprises a curvature of approximately 39 degrees. The rotatable connection between the upper segment to the middle segment comprises a male/female ball race.

The means for performing an elevation positioning of the monitor by synchronizing the simultaneous turning of the upper segment and the middle segment in opposite directions with respect to the lower segment comprises means for rotatably connecting a first ring gear on an inlet end of the middle segment, a second ring gear attached to the inlet end of the upper segment and engaging with the first ring gear, a half-ring gear attached to an outer receiving surface of the middle segment, and a pinion, rotatably connected on a side of the lower segment adjacent to the first ring gear and the half-ring gear, comprises a bevel gear for driving the first gear and the half-ring gear. The predetermined curvature of the lower segment of the conduit comprises a curvature of approximately 68 degrees, the predetermined curvature of the middle segment of the conduit comprises a curvature of approximately 34 degrees, the first curvature extending a predetermined distance from an inlet end of the upper segment of the conduit comprises a curvature of approximately 73 degrees, and the second curvature of the upper segment, extending over a predetermined distance from the first curvature distance to an outlet end, comprises a curvature of approximately 39 degrees.

The objects are further accomplished by a method of providing a firefighting monitor for redirecting a flow of fluid from a pressurized fluid source through a conduit comprising the step of providing a conduit having four consecutive segments rotatably connected in series wherein an axis of rotation is provided at each connection between the four segments. The step of providing a conduit having four segments rotatably connected in series comprises the steps of connecting a first segment to the fluid source followed in series by connecting a second segment to an outlet of the first segment, connecting a third segment to an outlet of the second segment and connecting a fourth segment to an outlet of the third segment forming consecutively at each connection a first axis of rotation, a second axis of rotation and a third axis of rotation respectively, redirecting an azimuth angle of the conduit by rotating the second segment around the first segment on the first axis of rotation, and redirecting an elevation angle of the conduit by rotating the second segment and the third segment on the second axis of rotation in a first direction, and by rotating the third segment and the fourth segment on the third axis of rotation in an opposite direction to the first direction. The method further comprises the step of synchronizing the first rotation between the second segment and the third segment and the second rotation between the third segment and the fourth segment in counter rotating directions to obtain approximately planar motion of the discharge centerline during the elevation angle redirection.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
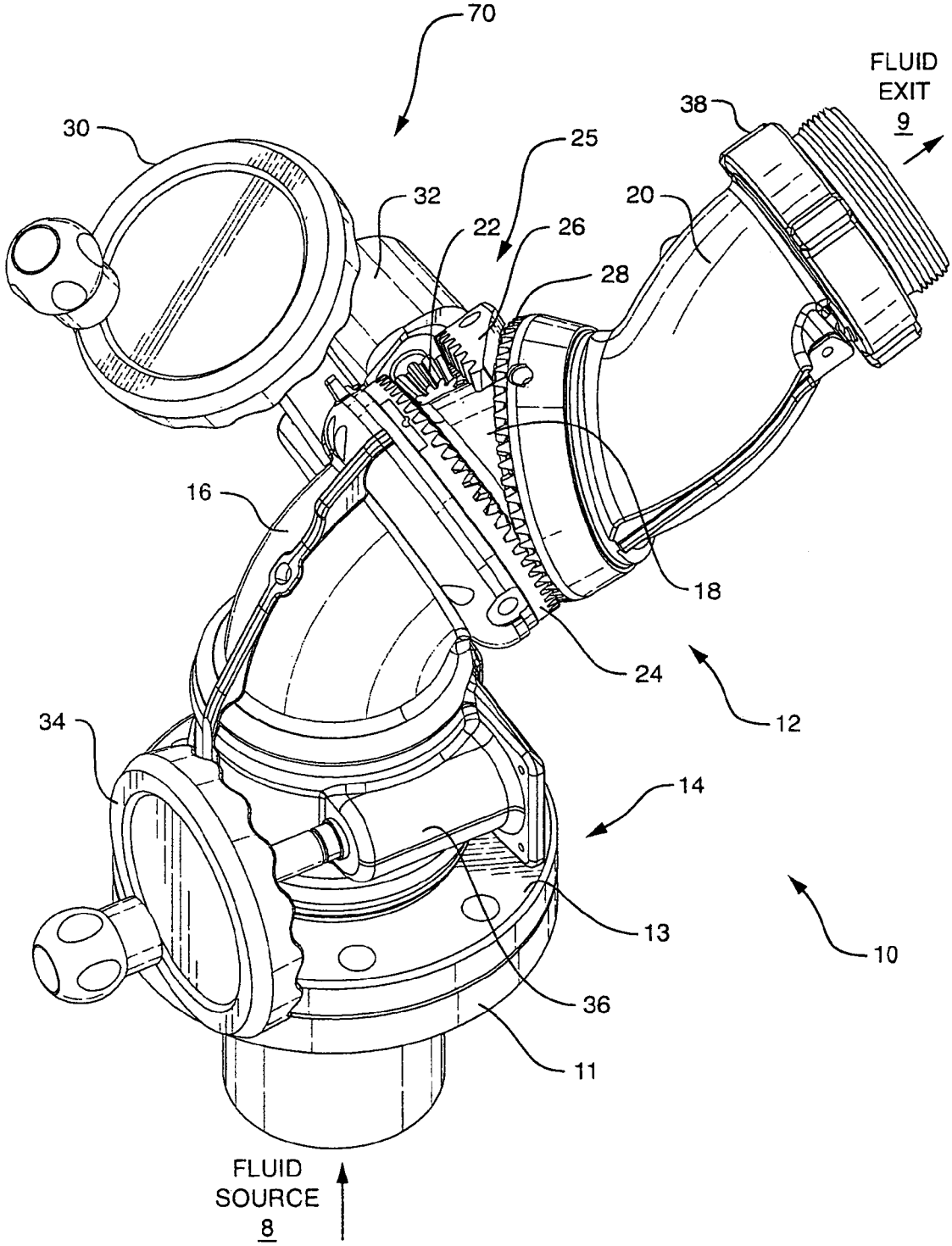
FIG. 1 is a rear perspective view of a firefighting segmented monitor according to the invention without safety shrouds.

Referring to FIG. 1, a perspective view of a firefighting segmented monitor 10 is shown according to the invention. The segmented monitor 10 is a conduit used to position the trajectory of a pressurized fluid source 8 (usually water), received at an inlet end of a first segment or stationary segment 13, and the fluid is discharged at the fluid exit 9 and directed towards a target. The segmented monitor 10 in fire service is generally fitted with a nozzle in order to increase the velocity of the fluid and deliver a straight stream over considerable distance. The segmented monitor 10 is shown in the preferred embodiment as a nominal 4 inch size and rated for a maximum flow of 2000 gallons per minute. However, other sizes of the segmented monitor 10 may be implemented. With the centerline of the monitor's stationary segment 13 vertical (fluid flowing straight up), the range of discharge elevation of the segmented monitor 10 is from 46 degrees below horizontal to 90 degrees above horizontal (straight up).

Figure 2:
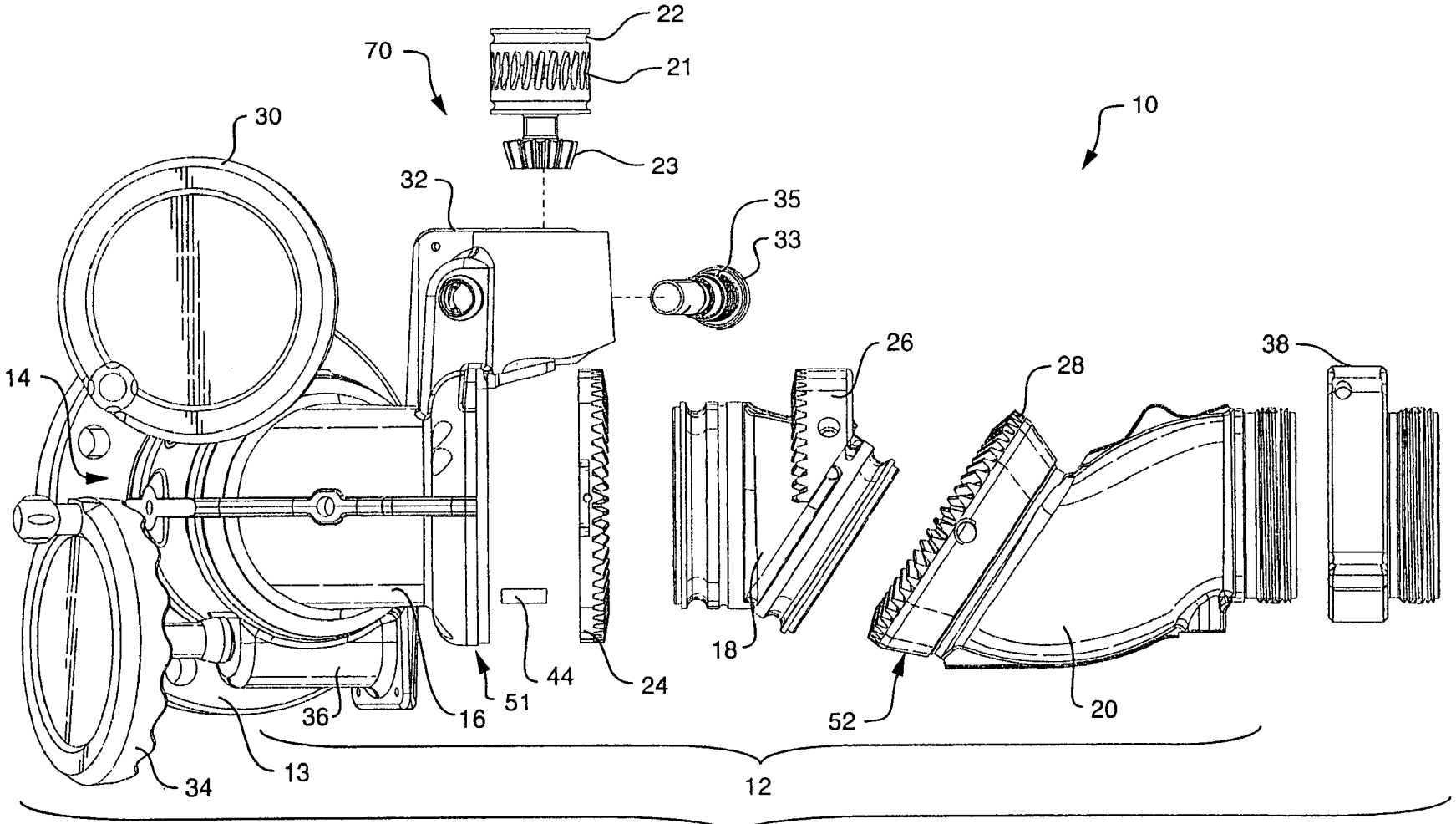
FIG. 2 is an exploded top view of the firefighting segmented monitor of FIG. 1 showing the major elements of a segmented flowpath.
Figure 3:
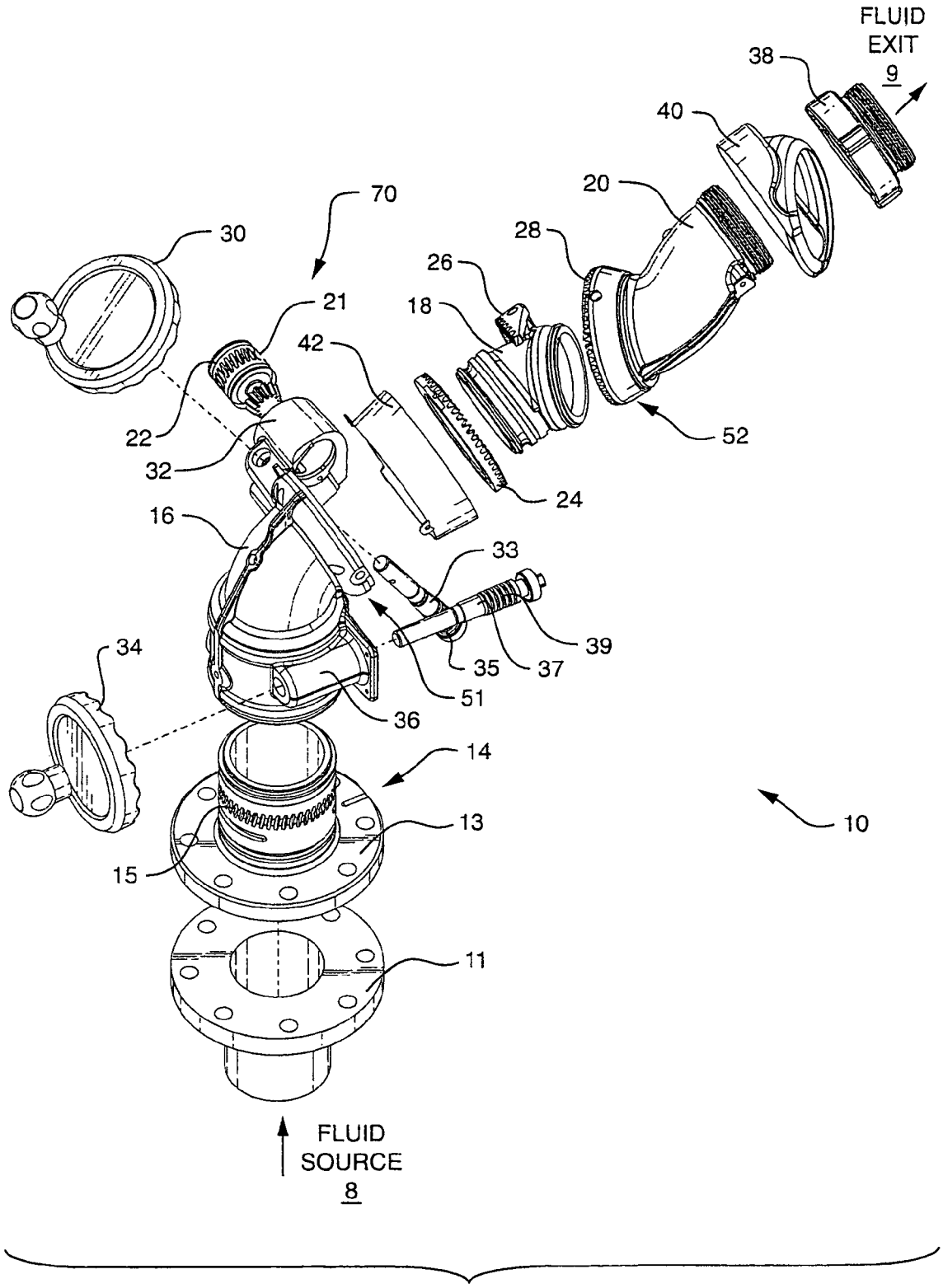
FIG. 3 is a detailed exploded perspective view of the firefighting segmented monitor of FIG. 1 showing an upper safety shroud and a lower safety shroud.
Figure 5:
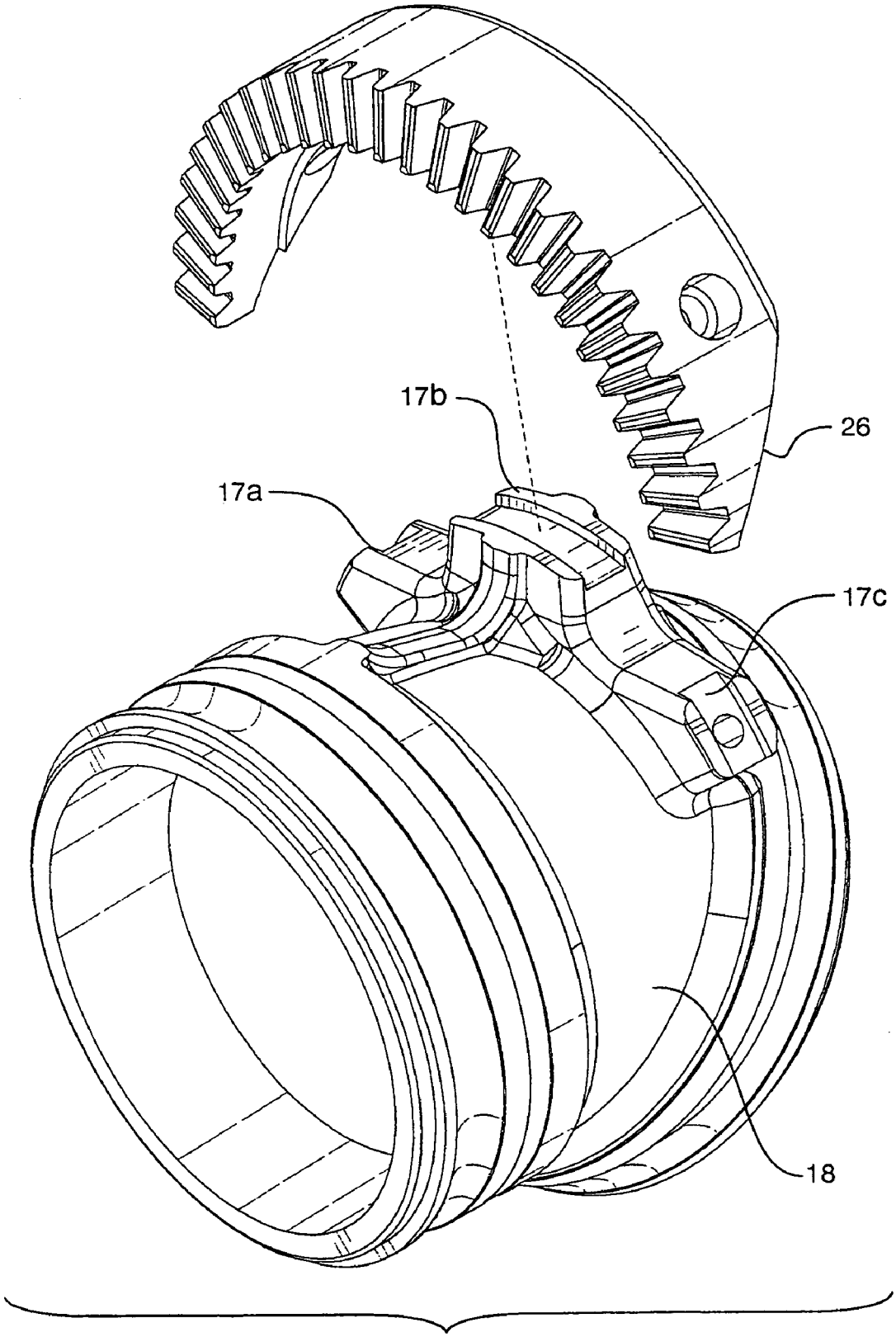
FIG. 5 is a partial exploded, top perspective view of the middle segment of the segmented monitor showing mounting structure for the half ring gear.
Figure 6:
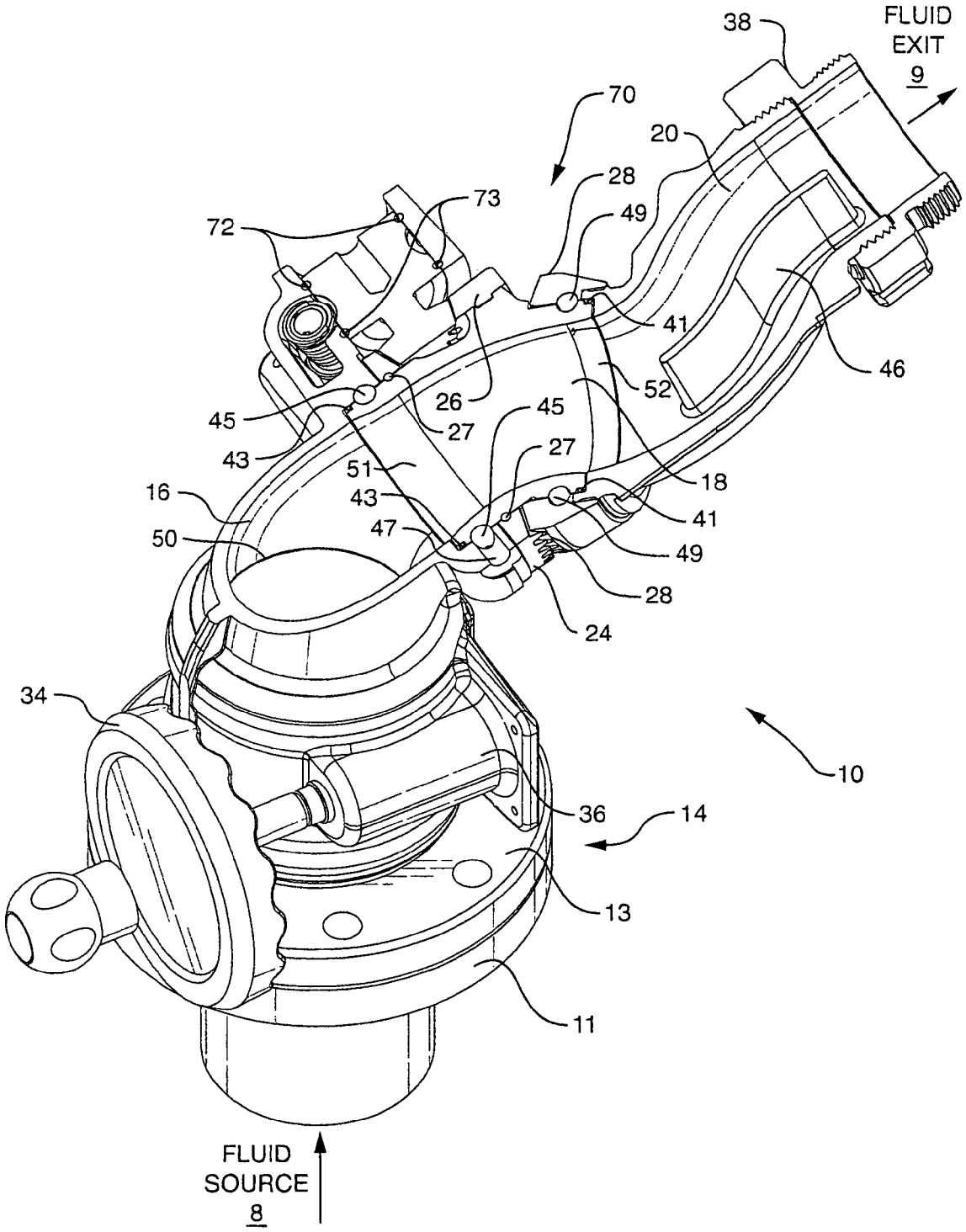
FIG. 6 is a perspective partial sectional view of the lower segment, middle segment and upper segment of the segmented monitor showing a straightening vane in the upper segment.
Figure 8:
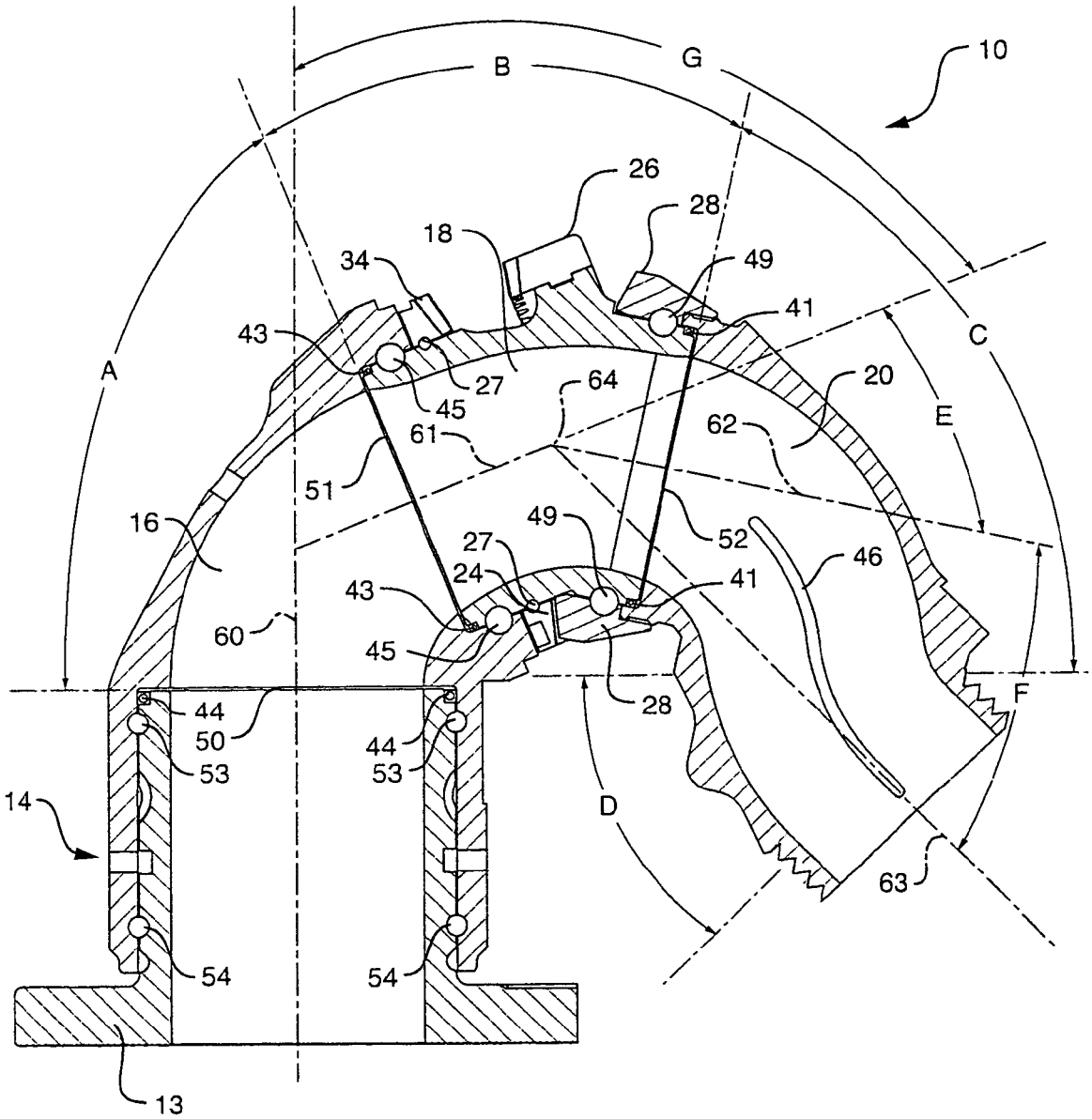
FIG. 8 is a sectional side elevational view of the segmented monitor showing the axes of rotation of the segmented joints when the monitor is adjusted to the minimum angle position, 46 degrees below horizontal.
Figure 11:
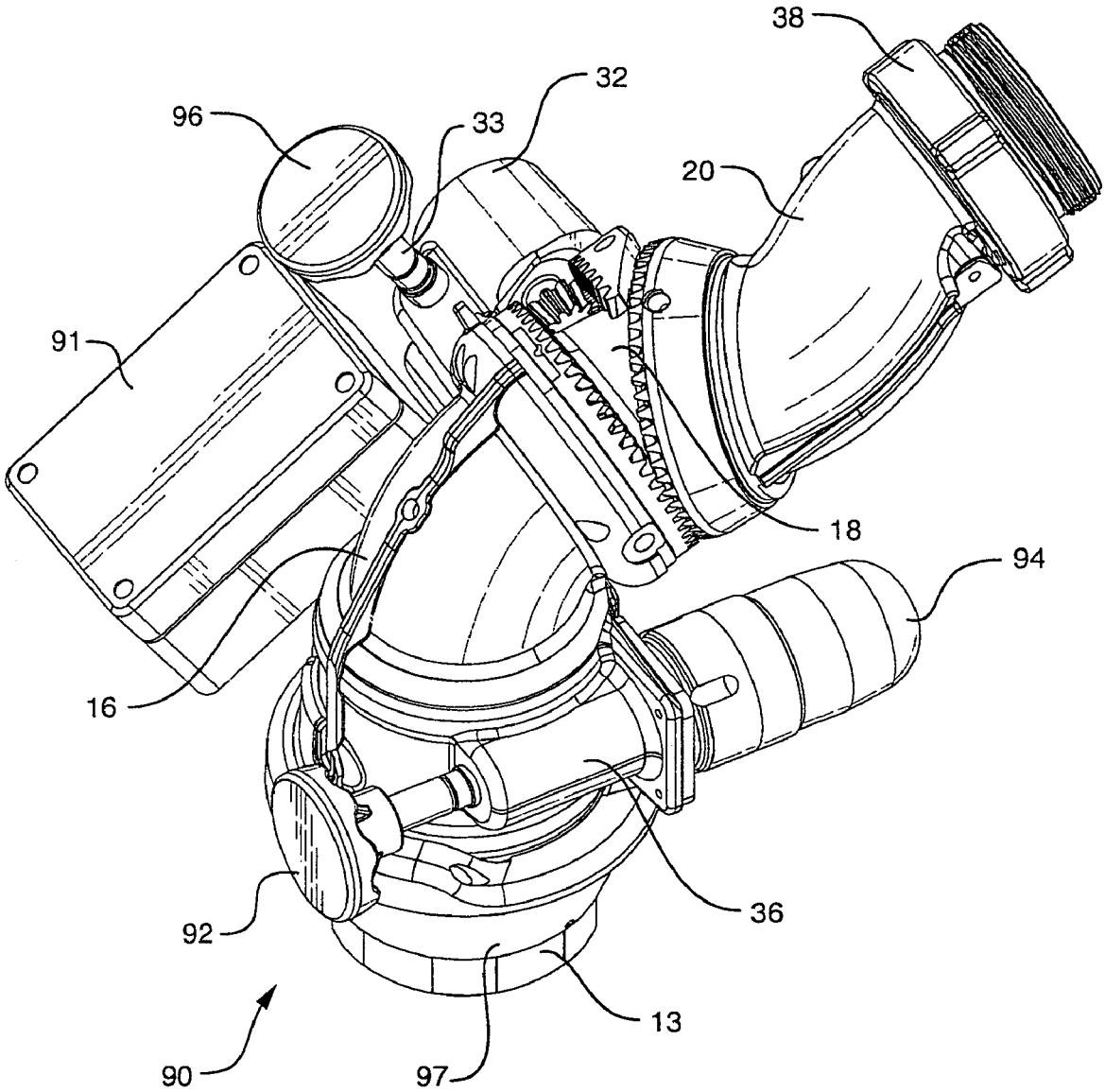
FIG. 11 is a rear perspective view of a segmented monitor having electric gearmotors and a motor control box for controlling the gearmotors for the azimuth and elevation positioning.
Figure 12:
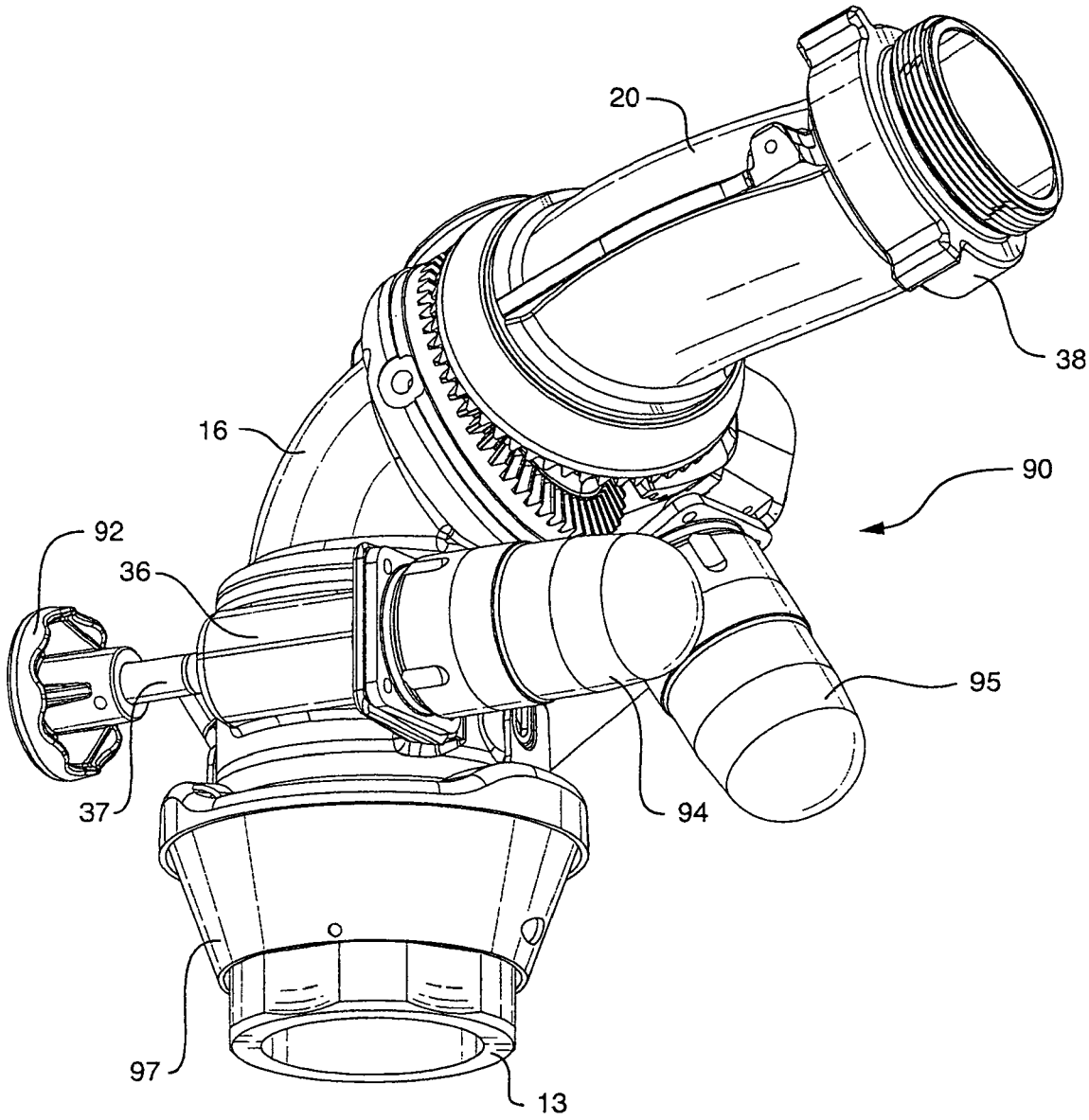
FIG. 12 is a front perspective view of the segmented monitor of FIG. 11 having electric gearmotors for adjusting the azimuth and elevation positioning.

Referring to FIGS. 1–3, FIG. 5 and FIG. 6, FIG. 2 is an exploded top view of the firefighting segmented monitor 10 comprising in series the first segment or stationary segment 13, a second segment or lower segment 16, a third segment or middle segment 18, and a fourth segment or upper segment 20 (the discharge end) which form the conduit or flowpath 12 of fluid through the monitor 10 with convolutions within the flowpath 12 totaling only 214 degrees. A minimum convolution flowpath results in reduced pressure loss, less turbulence and a longer discharge stream. An exit adapter 38 may be connected to the upper segment 20 for receiving various types of nozzles (not shown). For reference purposes as shown in FIG. 1 and FIG. 3, the fluid source 8 enters a flange 11 then travels through the flowpath 12 and is discharged at the fluid exit 9. The azimuth drive 14 comprises a housing 36 and a stationary segment 13. The housing 36 includes an azimuth shaft assembly 37 having a worm 39. A handwheel 34 is mounted to the azimuth shift assembly 37 and is used for adjusting the azimuth position of monitor 10. The worm 39 engages with a worm wheel 15 located around the circumference of an upper cylindrical portion of the stationary segment 13. The lower portion of the stationary segment 13 is attached by bolts (not shown) to the fluid source flange 11. An inlet end of lower segment 16 rotatably attaches to the exit end of the stationary segment 13 by a pair of male/female ball races 53, 54 (FIG. 8), which are commonly known in the art. The exit end of lower segment 16 is adjacent to a lower ring gear 24, which mates directly with an inlet end of the middle segment 18 by means of only one male/female ball race 45. FIG. 6 is a perspective partial sectional view of the segmented monitor 10 showing segments 16, 18, 20 and ball races 27, 45 and 49. The ball race 27 provides a swiveling interface between the lower ring gear 24 and the middle segment 18. The exit end of the middle segment 18 mates with an inlet end of the upper segment 20 by means of only one male/female ball race 49. Upper segment 20 includes a turning vane 46 for reducing turbulence. Referring to FIG. 5, a partially exploded top perspective of the middle segment 18 shows a half-ring gear 26 which attaches to locating mounting structure of surfaces 17*a*, 17*b*, 17*c* on the outside of the middle segment 18, and it is secured by screws (not shown). Referring to FIG. 2, FIG. 6 and FIG. 8, the inlet end of the upper segment 20 comprises an upper ring gear 28. The upper ring gear 28 mates directly with upper segment 20 by means of a threaded joint. Each swivel joint 50, 51, 52 between the segments 13, 16, 18, and 20 is sealed by O-rings 41, 43 and 44 to prevent leakage of the pressurized fluid within the flowpath 12. The exit end of the upper segment 20 connects to a selected nozzle or to the exit adaptor 38 by means of a threaded connection. In a similar way stationary segment 13 may include an inlet adaptor means (not shown) to connect with various water sources. It may also be threaded as depicted in FIGS. 11 and 12. The segments 13, 16, 18, 20 are made from corrosion resistant alloy such as aluminum, brass, bronze or stainless steel.

Figure 7:
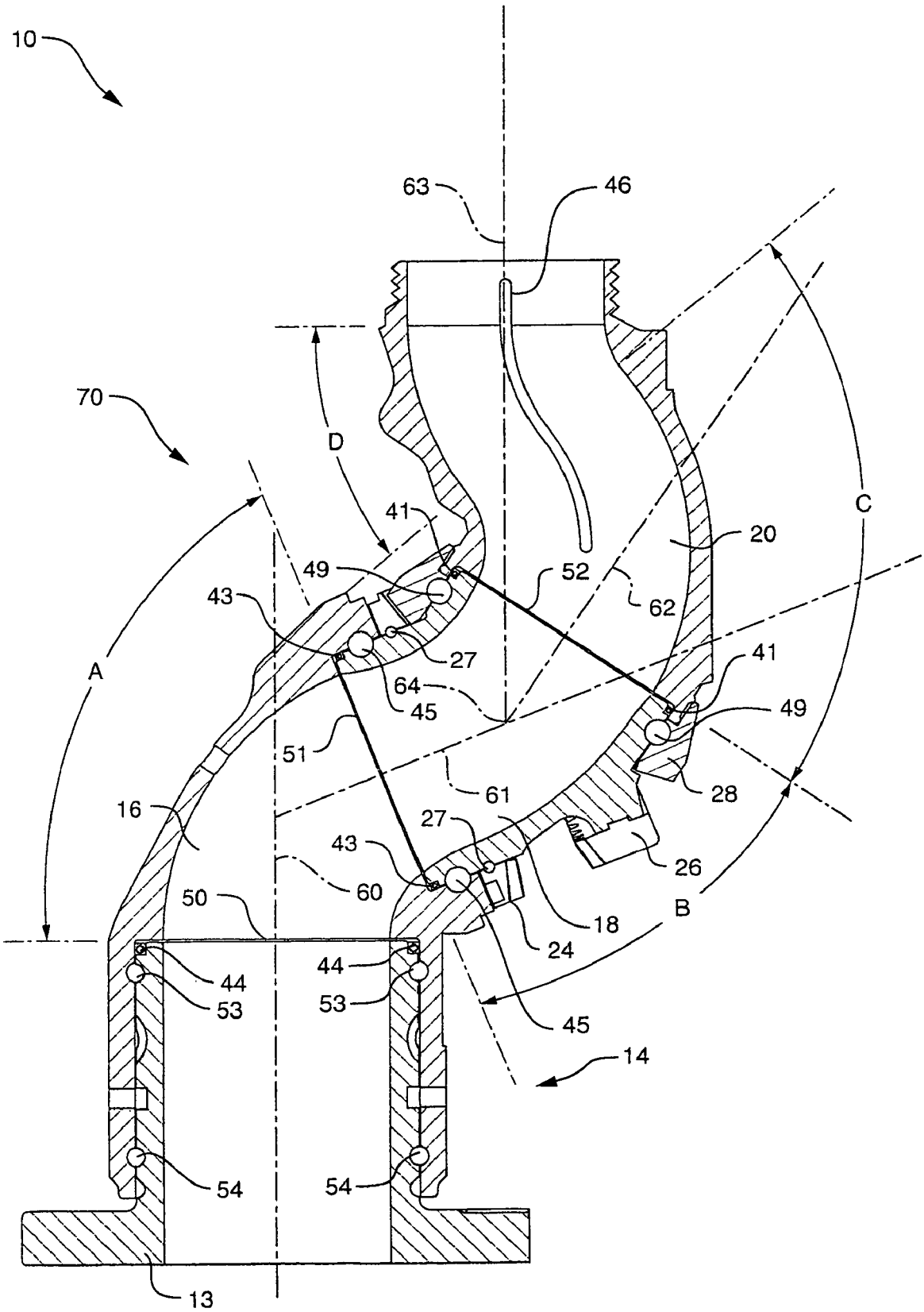
FIG. 7 is a sectional side elevational view of the segmented monitor showing the axes of rotation of the segmented joints when the monitor is adjusted to the maximum angle position, 90 degrees above horizontal.

Referring now to FIG. 7, a sectional side elevational view of the segmented monitor 10 is shown in the maximum angle position with axes of rotation of the swivel joints 50, 51 and 52 illustrated. The first swivel joint 50 formed at the joint of the stationary segment 13 and the lower segment 16 has an axis of rotation 60. Two male/female ball races 53, 54 are provided spaced apart around the cylindrical upper portion of the stationary segment 13 to enable the rotation of the lower segment 16 about the stationary segment 13. The O-ring 44 seals the interface between the stationary segment 13 and the lower segment 16 adjacent to ball race 53. The second swivel joint 51 formed at the joint of lower segment 16 to middle segment 18 has an axis 61 of rotation. The third swivel joint 52 formed at the joint of the middle segment 18 to upper segment 20 has an axis 62 of rotation. The center line 63 of the exit end of upper segment 20 is the center line of nozzle reaction. The inlet center line 60 of the stationary segment 13 is where side-to-side azimuth rotation of the monitor 10 occurs.

The inlet center line 60 and the outlet center line 63 are in the same elevation plane so that the force of a nozzle reaction does not produce a significant torque on the side-to-side swivel joint 50 (azimuth) of the azimuth drive 14. The inlet face and the outlet face of the middle segment 18 are angled relative to each other such that the desired range of elevation is obtained. The inlet end of the middle segment 18, the lower ring gear 24 and the half-ring gear 26 rotate about the axis 61. The shape of the upper segment 20 is such that a vector from the nozzle reaction acting along center line 63 passes through the intersection 64 of the inlet axis of rotation 61 and outlet axis of rotation 62 in the middle segment 18. Because the nozzle reaction stays on the centerline of both swiveling joints 51, 52, no torque is produced on these swiveling joints 51, 52 from the force of the nozzle reaction. This is important because the force from the nozzle reaction may be over 1000 pounds, and it is desirable to keep the required actuation power low.

Still referring to FIG. 7, the monitor 10 comprises minimum convolutions in the flowpath 12 in order to greatly reduce any pressure loss and turbulence. The first convolution after the stationary segment 13 is produced by the lower segment 16 and has an arc A which is 68 degrees. The second convolution is produced by the middle segment 18 and has an arc B which is 34 degrees. The third convolution is produced by an inlet portion of upper segment 20 and has an arc C which is 73 degrees. The third and fourth convolutions are arranged so that the centerline of nozzle reaction 63 passes through the intersection point 64 as previously described. The fourth convolution is produced by an outlet portion of upper segment 20 and has an arc D which is 39 degrees which extends from the end of the third convolution to the exit end of the upper segment 20. Therefore, the flowpath 12 of monitor 10 has a total flowpath convolution of 214 degrees which is the sum of the individual segment arcs A, B, C and D.

Referring to FIG. 8, a sectional side elevational view of the segmented monitor 10 is shown adjusted to the minimum angle position of the 46 degrees below horizontal with axes of rotation of segment joints 51, 52 illustrated. The second swivel joint 51 formed at the joint of lower segment 16 to middle segment 18 has an axis of rotation 61. The third swivel joint 52 at the joint of the middle segment 18 to upper segment 20 has an axis of rotation 62. The center line 63 of the exit end of upper segment 20 is the center line of the nozzle reaction. The center line 60 of the stationary segment 14 as previously described is where the side-to-side azimuth rotation of the monitor 10 occurs. The axis of rotation 61, the axis of rotation 62, and the center line 63 of the nozzle reaction intersect at a common point 64 in the middle segment 18. This design provides for the nozzle reaction to produce no torque on the swivel joints 50, 51 and 52.

Still referring to FIG. 8, the flowpath 12 comprises the stationary segment 13 and rotating segments 16, 18, 20 with minimal convolutions to provide the minimum monitor elevation angle of 46 degrees below horizontal. The first convolution after the stationary segment 13 is produced by the lower segment 16 which has an arc A of 68 degrees. The second convolution is produced by middle segment 18 which has an arc B of 34 degrees. The third convolution is produced by the inlet portion of the upper segment 20 which has an arc C of 73 degrees. The fourth convolution is produced by the outlet portion of the upper segment 20 which has an arc D of 39 degrees. Therefore, the flowpath 12 of monitor 10 when the monitor 10 is in the minimum angle position, has total convolutions of 214 degrees which is the sum of the individual arcs A, B, C and D, and the same total arc convolutions as when the monitor 10 is in the maximum angle position as shown in FIG. 7.

Still referring to FIG. 8, the angle G between the axis of rotation 60 and the axis of rotation 61 is 68 degrees (which is the same as arc A). The angle E between the axis of rotation 61 of the lower segment and the axis of rotation 62 of the middle segment 18 is 34 degrees (which is the same as arc B). Also the angle F between the axis of rotation 62 of the middle segment and the center line 63 of the nozzle reaction is 34 degrees. The angles E and F give the desired elevation range of elevation motions. The elevation angle of outlet center line 63 can vary from axis 61 by a maximum of (E+F)×2 or (34 degrees+34 Degrees)×2=136 degrees. Monitors with greater or lesser range of motion can be made by adjusting the angles E and F.

Figure 8A:
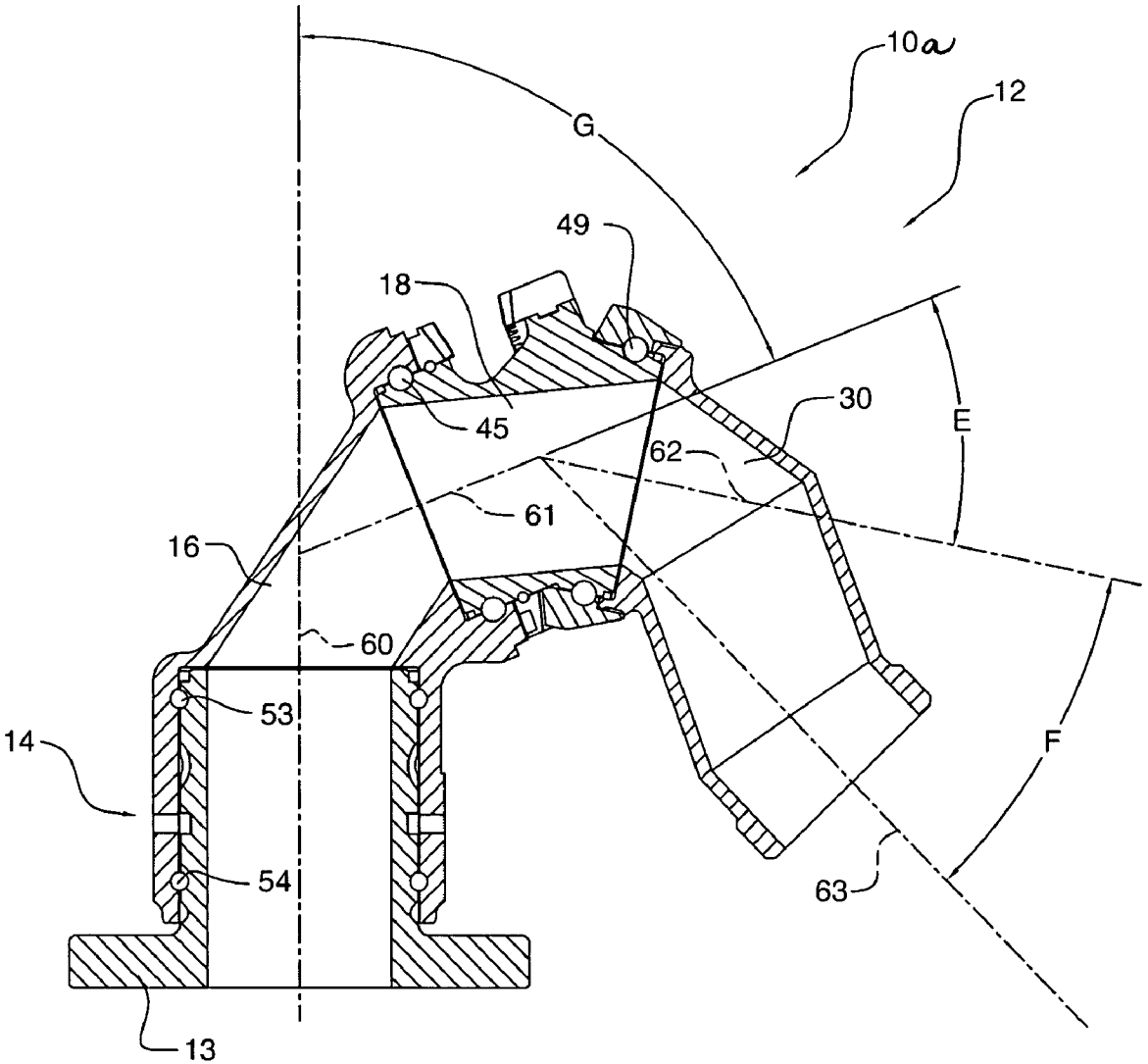
FIG. 8A is a sectional side view of an alternate embodiment of the segmented firefighting monitor of FIG. 8 having no curvature in the segments.

Referring now to FIG. 8A, the firefighting segmented monitor 10*a* is an alternate embodiment of the segmented monitor 10 shown in FIG. 8, wherein none of the four segments of segmented monitor 10*a* have curvature. Each segment is made entirely from straight cylindrical portions. However, the angles between the axes in FIG. 8A are the same as depicted in FIG. 8. Elimination of the curvature in one or more segments might be preferable for manufacturing a monitor using segments made from welded pipe rather than using the curved segments depicted in FIG. 8 which by their nature are preferably made using castings. The elimination of the curvature has the adverse effect of increasing turbulence through the monitor due to the abrupt kinks formed by the joint between adjacent segments. It can be seen that the monitor of FIG. 8 has a curvature in each segment equal to the angle of the convolutions, and likewise equal to the angle between the axis of rotation. Likewise, it can be seen that the monitor of FIG. 8A has no curvature, yet the total convolutions of the monitor of FIG. 8A are the same as the monitor of FIG. 8, and the angles between the axes of rotation of FIG. 8*a* are the same as the angles between the axes of rotation of FIG. 8.

Figure 4:
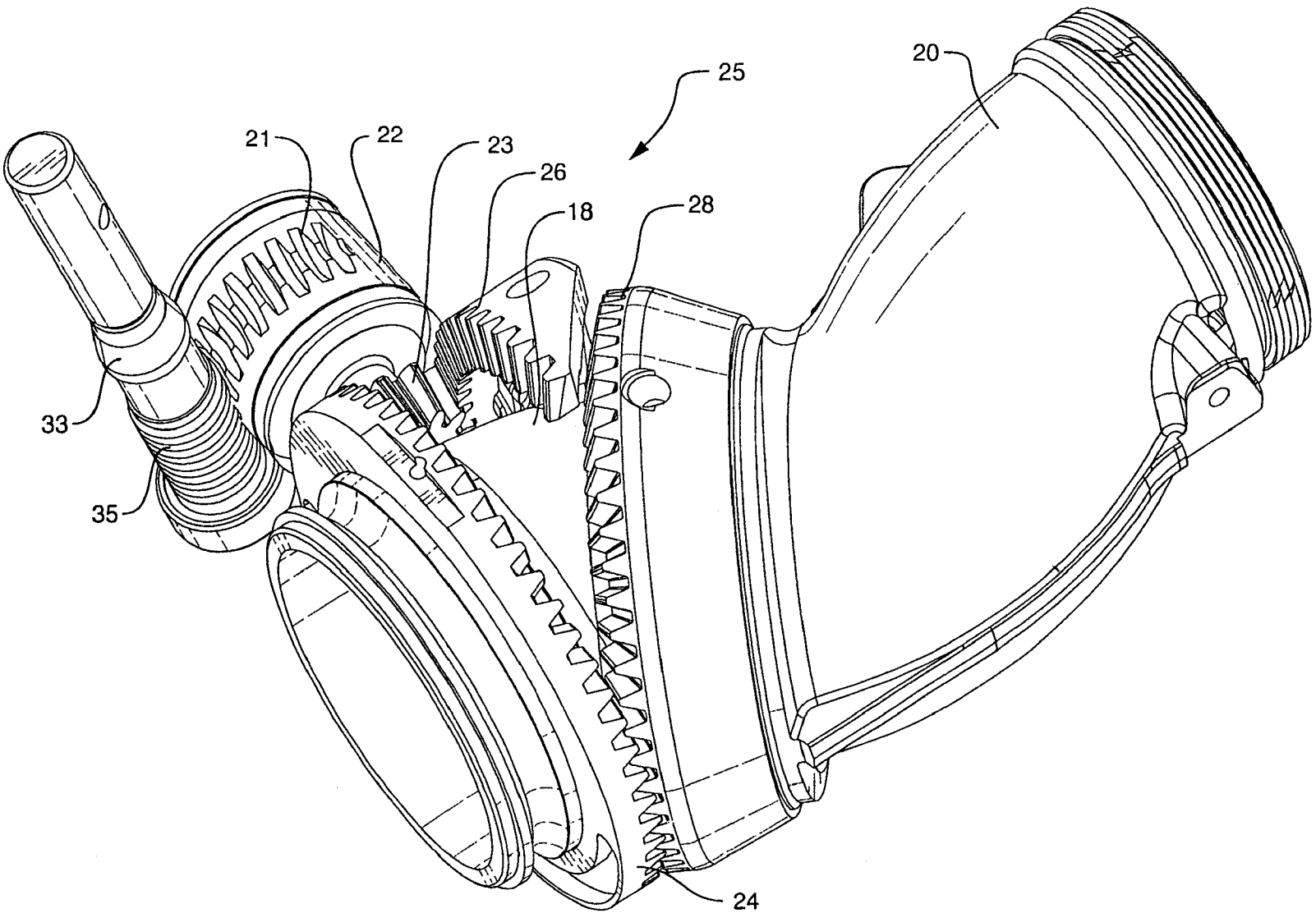
FIG. 4 is a top perspective view of the ring gears of the segmented monitor driven by a pinion having a worm gear and a bevel gear.

Referring again to FIG. 1, FIG. 2, and also FIG. 3, FIG. 3 is an exploded perspective view of the segmented monitor 10 showing an upper safety shroud 40 and a lower safety shroud 42 for covering the gear train 25. The redirection of the elevation angle by elevation drive 70, comprises all the elements necessary to rotate swivel joints 51 and 52. Extending from the side of lower segment 16 is a housing 32 for receiving the pinion 22 and elevation shaft sub-assembly 33. The elevation shaft sub-assembly 33 comprises a worm 35 to drive the worm wheel 21 of pinion 22 which then drives the rest of the elevation gear train 25 as shown in FIG. 4. A handwheel 30 mounts on the elevation shaft subassembly 33 for adjusting the elevation position of monitor 10. The pinion 22 mates with the side of the lower segment 16 and is retained by two male/female ball races 72, 73 (FIG. 6) commonly known in the art and similar to the ball race 27. The pinion 22 drives the lower ring gear 24 and the half-ring gear 26 in counter rotating directions simultaneously. The self-locking nature of the worm wheel 21 maintains the elevation position of the flowpath 12, and the pitch of the worm wheel 21 is low enough so that the monitor's elevation does not lower due to the weight of a nozzle attached at the fluid exit 9. The azimuth drive 14 comprises the housing 36 which receives the azimuth shaft subassembly 37, and the stationary segment 13 for mating with the fluid source flange 11. Another handwheel 34 mounts on the end of the azimuth shaft subassembly 37 for adjusting the azimuth position of the monitor 10.

Referring to FIGS. 1–4, FIG. 3 shows the upper safety shroud 40 and the lower safety shroud 42 for covering the gear train area 25 for safety and protection of the gears against damage. Shrouds 40, 42 are omitted from all the other figures. FIG. 4 shows a top perspective view of the operating gear train 25 arrangement including the bevel gear 23 of pinion 22, the ring gears 24, 28, and half-ring gear 26. The half-ring gear 26 transmits rotation from the bevel gear 23 to the middle segment 18. The lower ring gear 24 and the upper ring gear 28 are set at 34 degrees to each other in order to match the angle of the middle segment 18. The lower ring gear 24 transmits rotation from the pinion bevel gear 23 to the upper ring gear 28. The upper ring gear 28 mates directly with the inlet end of upper segment 20 and causes the upper segment 20 to rotate relative to the middle segment 18. The upper ring gear 28 has the same number of gear teeth and pitch diameters as the lower ring gear 24 so that the gears 24 and 28 move at the same rate. This feature is important because it gives the proper fixed gear ratios for the monitor 10 to approximate planar motion throughout the range of monitor discharge angles. The maximum variation of the discharge nozzle centerline from an ideal elevation center plane is approximately 4 degrees for the full range of the segmented monitor 10 elevation discharge motion.

Still referring to FIG. 2, and FIG. 4, the bevel gear 23 of pinion 22 drives the ring gear 24 and the half-ring gear 26 in a counter rotating direction. The bevel gear 23 rotates in response to movement of the pinion 22, which comprises a worm wheel 21, driven by an elevation shaft subassembly 33 when the discharge elevation angle of the monitor 10 is changed. An elevation stop pin 44 is provided which limits the travel of the lower ring gear 24, and thereby the rest of the elevation gear train 25, so that beveled gear 23 always stays engaged with the half-ring gear 26 and limits the travel of the entire elevation gear train 25. The stop pin 44 fits into a round hole in the lower segment 16 and one end protrudes into a slot in the back of the lower ring gear 24 whereby travel is limited by the pin 44 hitting the ends of the slot.

Referring again to FIG. 4, the main purpose of the gear train 25 is to rotate the middle segment 18 and the upper segment 20 in opposite directions at the same rate relative to the lower segment 16. For example, when the middle segment 18 rotates ten degrees clockwise, the upper segment 20 rotates ten degrees counterclockwise. The lower ring gear 24, half-ring gear 26, and upper ring gear 28 all have the same pitch diameter and diametral pitch so they always move in a one-to-one ratio. The bevel gear 23 meshes simultaneously with the lower ring gear 24 and the half-ring gear 26 and gives these two gears an equal rotational movement but in opposite directions. When the middle segment 18 rotates 'X' degrees in one direction relative to the lower segment 16, the upper segment 26 will rotate '2X' degrees in the opposite direction relative to the middle segment 18. The lower ring gear 24, half-ring gear 26 and inlet of the middle segment 18 all rotate about the axis of rotation 61 (see FIG. 7). Only 180 degrees of rotation of the middle segment 18 are needed to give the full range of the monitor's elevation angles. Any rotation of the middle segment 18 beyond 180 degrees results in redundant motion of the discharge elevation angle. The gear train 25 only allows for 180 degrees of rotation since the half-ring gear 26 is only a gear segment of approximately 180 degrees. Travel is limited to 180 degrees by the elevation stop pin 44 which is contained by the lower segment 16 and engages the slot in the lower ring gear 24. Additional travel stops are provided by threaded pieces that screw into the lower segment 16 and engage the slot in the lower ring gear 24. These additional travel stops are used for cases where the full travel of the monitor could be undesirable. The gear train 25 specifications for the segmented monitor 10 are specified in Tables 1 and 2.

Table 1 lists the specification for the worm 35 to worm wheel 21. There is a 1.500 inch center-to-center distance from worm 35 to worm wheel 21.

TABLE 1

| WORM 35 TO WORM WHEEL 21 | |
|---|---|
| WORM 35 | WORM WHEEL 21 |
| 12 diametral pitch worm<br>0.9950 inch pitch diameter<br>0.2818 inch lead<br>14.5 degree pressure angle<br>Right hand single lead | 12 diametral pitch<br>24 teeth right hand single lead<br>1.992 inch pitch diameter<br>14.5 degree pressure angle |

Table 2 lists the specification of the bevel gears 23, 24, 26 and 28. The pitch angle between the lower ring gear 24 (77 degrees) and the upper ring gear 28 (69 degrees) gives a 34 degree rotation axis change (180−77−69=34 degrees corresponding to angle E of FIG. 7).

TABLE 2

| BEVEL GEARS | | |
|---|---|---|
| BEVEL GEAR 23 | LOWER RING GEAR 24 AND HALF RING GEAR 26 | UPPER RING GEAR 28 |
| Straight bevel gear<br>12 teeth<br>8.86 diametral pitch<br>1.355 inch pitch diameter<br>20 degree pressure angle<br>13 degree pitch angle | Straight bevel gear<br>52 teeth for a complete ring<br>8.86 diametral pitch<br>5.869 inch pitch diameter<br>20 degree pressure angle<br>77 degree pitch angle | Straight bevel gear<br>52 teeth for a complete ring<br>8.86 diametral pitch<br>5.869 inch pitch diameter<br>20 degree pressure angle<br>69 degree pitch angle |

While bevel gearing is preferred because of its compact nature, other drives may be implemented providing the synchronization between the upper and middle segments is maintained.

Referring again to FIG. 2 and FIG. 6, for redirecting the discharge elevation angle of monitor 10, there are two nonorthogonal swivel joints 51, 52 which are arranged such that they can be driven by the above gearing of fixed gear ratio to produce approximately vertical planar motion of the monitor 10 discharge nozzle. Swivel joint 51 is embodied by the single ball race 45 at the interface of the lower segment 16 and the middle segment 18. Swivel joint 52 is embodied by the single ball race 49 at the interface of the middle segment 18 and the upper segment 20. The swivel joints 50, 51 and 52 for firefighting monitor 10 are made with essentially male and female tubes. The male tube has a nearly semicircular groove on its outside diameter. The female tube has a nearly semicircular groove on its inside diameter. The male tube and female tube fit one inside the other and spherical balls are installed via a ball channel, such as ball channel 47 for swivel joint 51, into the semicircular grooves thereby fixing the tubes to each other in an axial direction but allowing relative rotation between the two tubes. The resulting joints 50, 51 and 52 will rotate freely under radial load from the forces of the nozzle reaction and rotate freely under axial load (from internal pressure) since the balls act as rolling bearing elements. The balls for swivel joints 51, 52 and 27 are preferably made from polyamide-imide to minimize contact stress on the semicircular grooves because swivel joints 51, 52, and 27 have only a single male/female ball race. The remaining races are preferably filled with stainless steel balls which are less costly. The male/female races can also be shaped to accept other bearing types including roller, tapered roller, and needle bearings. The second swivel joint 51 and the third swivel joint 52 are synchronized by the external gearing shown in FIG. 4 with the fixed gear ratio that approximates planar motion of the monitor's discharge throughout the range of travel in response to rotation of handwheel 30.

Figure 9:
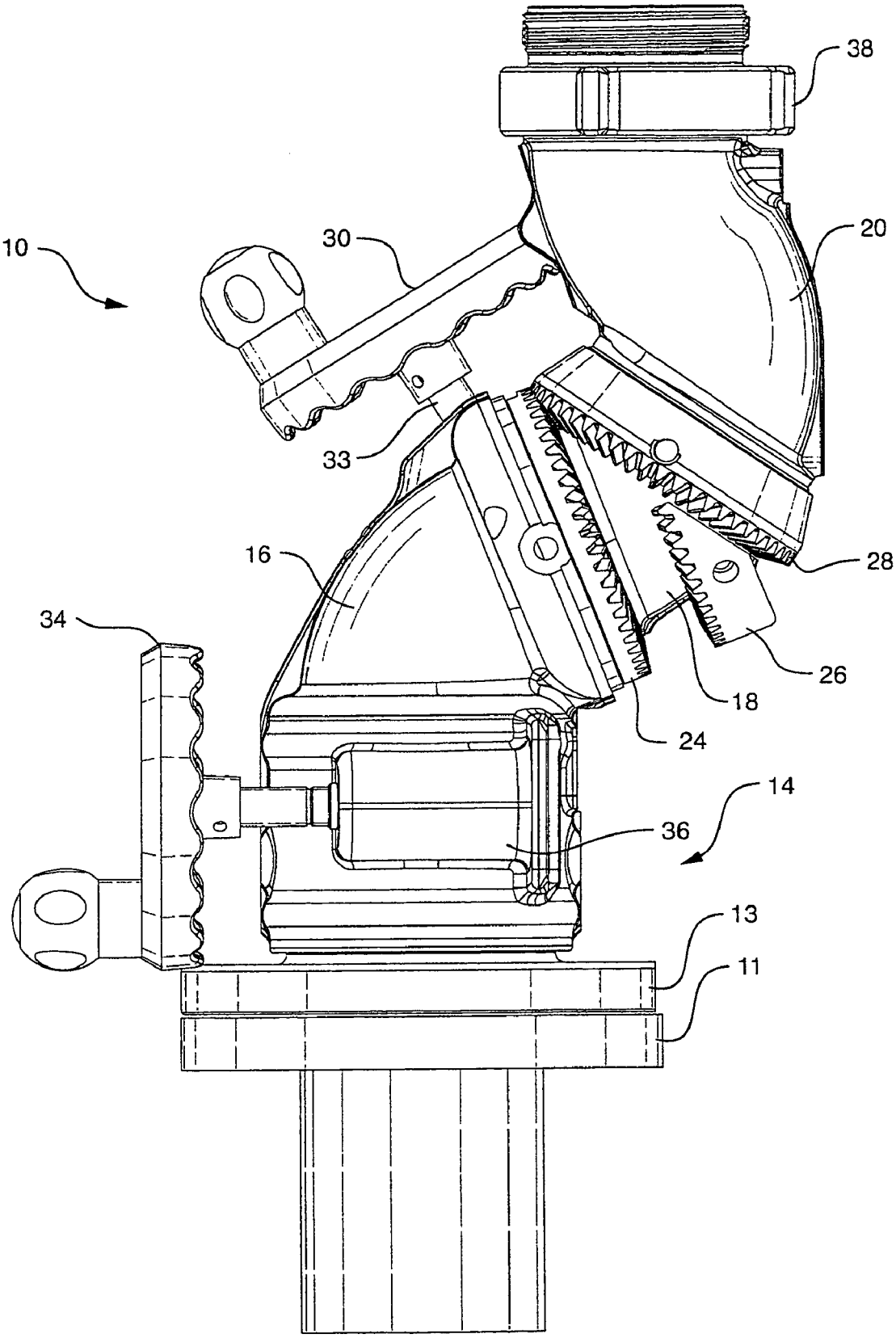
FIG. 9 is a side elevational view of the firefighting segmented monitor of FIG. 1 adjusted to a maximum angle position, 90 degrees above horizontal.
Figure 10:
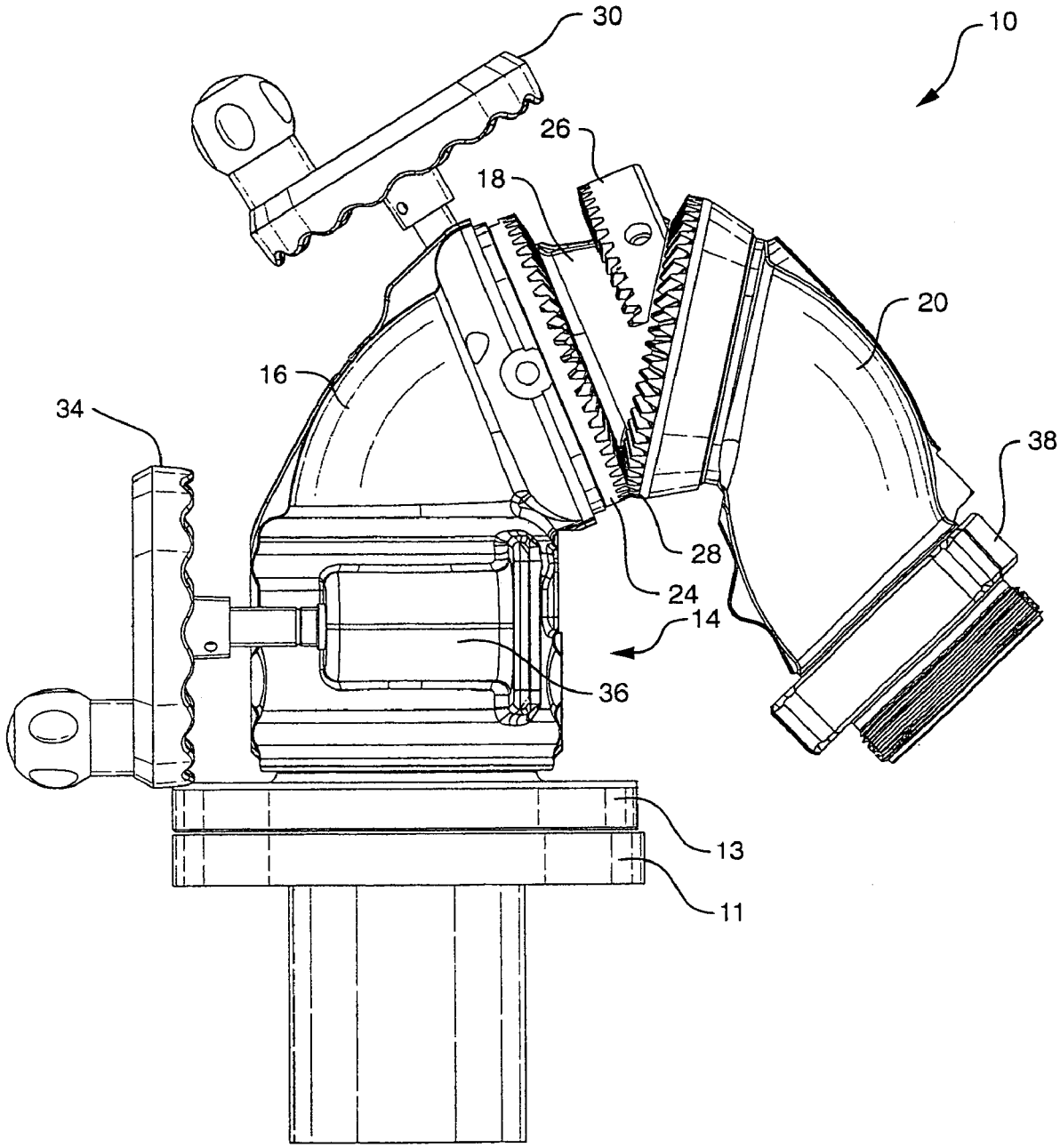
FIG. 10 is a side elevational view of the segmented firefighting monitor of FIG. 1 adjusted to a minimum angle position of 46 degrees below horizontal.

Referring to FIG. 9 and FIG. 10, FIG. 9 is a side elevational view of the firefighting segmented monitor 10 of FIG. 1 adjusted by handwheel 30 to a maximum angle position of 90 degrees above horizontal. In this position the half-ring gear 26 which rotates with the middle segment 18, ends up under the upper segment 20. FIG. 10 is a side elevational view of the monitor 10 adjusted by handwheel 30 to a minimum angle of 46 degrees below horizontal. In this position the half-ring gear 26, which rotates with the middle segment 18, ends up above the upper segment 20. During the range of travel of the discharge end of the upper segment 20 or exit adapter 38 when going from maximum angle to minimum angle, there is only a maximum variation of the discharge centerline 63 from the ideal vertical center plane of approximately four degrees.

Referring to FIG. 11 and FIG. 12, FIG. 11 shows a rear perspective view of an alternate embodiment of a segmented monitor 90 comprising a motor controller 91 for controlling azimuth electric gearmotor 94 for azimuth positioning, and FIG. 12 shows a front perspective view of the segmented monitor 90 comprising elevation electric gearmotor 95 controlled by the motor controller 91 for elevation positioning. The azimuth shaft assembly 37 and the elevation shaft assembly 33 each comprise a small handwheel 92, 96 for manual override in the event of a gearmotor or power failure. Wires to the motor controller 91 are secured within the wire cover 97 for limited back and forth azimuth rotational displacements or the wire cover 97 can include slip rings for carrying the electrical contacts so as to provide for unlimited azimuth rotational displacements in either direction.

The motor controller 91 comprises input controls for selecting position and nozzle control inputs to the segmented monitor 90. The input controls include switches for left, right, up and down position inputs, a fog switch, and a straight stream switch for selecting the type of nozzle output.

The azimuth and elevation gearmotors 94, 95 may each be embodied by Part No. GM 14634A140 manufactured by PITTMAN, of Harleysville, Pa. along with the motor controller 91. It will be apparent to one skilled in the art that the segmented monitor 10 may be automated by other types of motors such as hydraulic, or water actuated providing they have reversible drives. Further, electric gear motors may be DC or AC, single phase or multiphase.

This invention has been disclosed in terms of a certain embodiments. It will be apparent that many modifications can be made to the disclosed apparatus without departing from the invention. For example, synchronization of the motions of the middle and upper segments could also be performed using other driving devices such as cams, cables, cog teeth, or spur gears, or synchronization by use of hydraulic fluid volumes. Digital synchronization may be implemented with twin servo or stepper motors each driving one of the swivel/joints 51 and 52. Therefore, it is the intent of the appended claims to cover all such variations and modifications as come within the true spirit and scope of this invention.

What is claimed is:

1. A firefighting monitor for redirecting a flow of fluid from a pressurized fluid source through a conduit, said conduit comprising:

four consecutive segments rotatably connected in series wherein an axis of rotation is provided at each connection between said four segments;

a first segment connected to said fluid source followed in series by a second segment connected to an outlet of said first segment, a third segment connected to an outlet of said second segment and a fourth segment connected to an outlet of said third segment forming consecutively at each connection a first axis of rotation, a second axis of rotation and a third axis of rotation respectively;

said monitor includes a redirection of an azimuth angle of said conduit by an azimuth rotation between said first segment and said second segment on said first axis of rotation; and said monitor further includes a redirection of an elevation angle of said conduit by a second rotation between said second segment and said third segment on said second axis of rotation in a second rotation direction and by a third rotation between said third segment and said fourth segment on said third axis of rotation in an opposite direction to said second rotation direction; and said fourth segment comprises a discharge end having a discharge centerline which intersects with a centerline of said second axis of rotation and a centerline of said third axis of rotation, thereby minimizing rotational torque on said connection between said second segment and said third segment and the rotational torque on said connection between said third segment and said fourth segment.

2. The firefighting monitor as recited in claim 1 wherein said redirection of an elevation angle includes a synchronization of said second rotation between said second segment and said third segment and said third rotation between said third segment and said fourth segment in counter rotating directions to obtain approximately planar motion of said discharge centerline during said elevation angle redirection.

3. The firefighting monitor as recited in claim 2 wherein said monitor comprises an angle of approximately 68 degrees between said first axis of rotation and said second axis of rotation.

4. The firefighting monitor as recited in claim 2 wherein said monitor comprises an angle of approximately 34 degrees between said second axis of rotation and said third axis of rotation.

5. The firefighting monitor as recited in claim 2 wherein said monitor comprises an angle of approximately 34 degrees between said third axis of rotation and said discharge centerline.

6. The firefighting monitor as recited in claim 2 wherein said monitor comprises an angle between said second axis of rotation and said third axis of rotation and a substantially equal angle between said third axis of rotation and said discharge centerline.

7. The firefighting monitor as recited in claim 1 wherein at least one of said rotatable connections comprises a male ball race disposed inside of a female ball race and a plurality of bearing balls engaging both said male and female ball races.

8. The firefighting monitor as recited in claim 2 wherein said synchronization comprises gears.

9. The firefighting monitor as recited in claim 8 wherein said gears comprise bevel gears.

10. The firefighting monitor as recited in claim 2 wherein said redirection of an elevation angle of said conduit comprises:

a first ring gear rotatably connected on an inlet end of said third segment;

a second ring gear attached to an inlet end of said fourth segment, said second ring gear engaging said first ring gear at a predetermined angle;

a half-ring gear attached to an outer receiving surface of said third segment; and a pinion, rotatably connected on a side of said second segment adjacent to said first ring gear and said half-ring gear, comprising a bevel gear for driving said first ring gear and said half-ring gear in opposite directions.

11. The firefighting monitor as recited in claim 10 wherein:

said conduit further comprises an elevation shaft assembly having an end connected to a second turning device for adjusting said elevation angle; and said pinion comprises a worm wheel for engaging with a worm of said elevation shaft assembly for changing said elevation angle in response to said second turning device.

12. The firefighting monitor as recited in claim 10 wherein said first ring gear and said second ring gear engage each other at an angle substantially equal to an angle between said second axis of rotation and said third axis of rotation.

13. A firefighting monitor for redirecting a flow of fluid from a pressurized fluid source through a conduit comprising:

four consecutive segments rotatably connected in series wherein an axis of rotation is provided at each connection between said four segments;

a first segment connected to said fluid source followed in series by a second segment connected to an outlet of said first segment, a third segment connected to an outlet of said second segment and a fourth segment connected to an outlet of said third segment forming consecutively at each connection a first axis of rotation, a second axis of rotation and a third axis of rotation respectively;

said monitor includes a redirection of an azimuth angle of said conduit by an azimuth rotation between said first segment and said second segment on said first axis of rotation;

said monitor further includes a redirection of an elevation angle of said conduit by a second rotation between said second segment and said third segment on said second axis of rotation in a second rotation direction and by a third rotation between said third segment and said fourth segment on said third axis of rotation in an opposite direction to said second rotation direction;

said second segment comprises a predetermined curvature adjacent to an outlet end;

said third segment comprises a predetermined curvature between an inlet end and said outlet end; and said fourth segment comprises a first curvature extending from an inlet end and a second curvature extending to an outlet end of said fourth segment.

14. The firefighting monitor as recited in claim 13 wherein said fourth segment comprises said first curvature and said second curvature to minimize rotational torque on the connection between said first segment and said second segment.

15. The firefighting monitor as recited in claim 13 wherein:

said predetermined curvature of said second segment comprises approximately 68 degrees;

said predetermined curvature of said third segment comprises approximately 34 degrees; and said first curvature of said fourth segment comprises approximately 73 degrees and said second curvature of said fourth curvature comprises approximately 39 degrees.

16. A firefighting monitor for redirecting a flow of fluid from a pressurized fluid source through a conduit comprising:

four consecutive segments rotatably connected in series wherein an axis of rotation is provided at each connection between said four segments;

a first segment connected to said fluid source followed in series by a second segment connected to an outlet of said first segment, a third segment connected to an outlet of said second segment and a fourth segment connected to an outlet of said third segment forming consecutively at each connection a first axis of rotation, a second axis of rotation and a third axis of rotation respectively;

said monitor includes a redirection of an azimuth angle of said conduit by an azimuth rotation between said first segment and said second segment on said first axis of rotation;

said monitor further includes a redirection of an elevation angle of said conduit by a second rotation between said second segment and said third segment on said second axis of rotation in a second rotation direction and by a third rotation between said third segment and said fourth segment on said third axis of rotation in an opposite direction to said second rotation direction;

said first segment is rotatably connected to said second segment by a first male/female ball race;

said second segment is rotatably connected to said third segment by a second male/female ball race; and said third segment is rotatably connected to said fourth segment by a third male/female ball race.

17. A firefighting monitor for redirecting a flow of fluid from a pressurized fluid source through a conduit comprising:

a stationary segment connected to said fluid source;

a lower segment of said conduit having a predetermined curvature between an inlet end and an outlet end, said inlet end being rotatably connected to said stationary segment, said lower segment including means for enabling azimuth rotation of said monitor;

a middle segment of said conduit having a predetermined curvature between an inlet end and an outlet end, said middle segment being rotatably connected to said lower segment;

an upper segment of said conduit having a first curvature extending from an inlet end and a second curvature extending to an outlet end of said upper segment, said upper segment being rotatably connected to said middle segment; and means for performing an elevation positioning of said monitor by synchronizing the simultaneous rotation of said upper segment and said middle segment in opposite directions with respect to said lower segment.

18. The firefighting monitor as recited in claim 17 wherein said means for enabling azimuth rotation of said monitor includes said lower segment rotating about a cylindrical portion of said stationary segment.

19. The firefighting monitor as recited in claim 17 wherein said means for providing azimuth rotation of said monitor comprises an azimuth shaft assembly connected to a first turning device.

20. The firefighting monitor as recited in claim 19 wherein said azimuth shaft assembly comprises a worm for engaging a worm wheel located on the circumference of said stationary segment.

21. The firefighting monitor as recited in claim 17 wherein said predetermined curvature of said lower segment of said conduit comprises a curvature of approximately 68 degrees.

22. The firefighting monitor as recited in claim 17 wherein said predetermined curvature of said middle segment of said conduit comprises a curvature of approximately 34 degrees.

23. The firefighting monitor as recited in claim 17 wherein said means for rotatably connecting said middle segment to said lower segment comprises a male ball race disposed inside of a female ball race and a plurality of bearing balls engaging both said male and female ball races.

24. The firefighting monitor as recited in claim 17 wherein said first curvature extending a predetermined distance from an inlet end of said upper segment of said conduit comprises a curvature of approximately 73 degrees.

25. The firefighting monitor as recited in claim 17 wherein said second curvature of said upper segment extending over a predetermined distance from said first curvature distance to an outlet end comprises a curvature of approximately 39 degrees.

26. The firefighting monitor as recited in claim 17 wherein said rotatable connection between said upper segment to said middle segment comprises a male/female ball race.

27. The firefighting monitor as recited in claim 17 wherein said means for performing an elevation positioning of said monitor by synchronizing the simultaneous turning of said upper segment and said middle segment in opposite directions with respect to said lower segment comprises:

means for rotatably connecting a first ring gear on an inlet end of said middle segment;

a second ring gear attached to said inlet end of said upper segment and engaging with said first ring gear;

a half-ring gear attached to an outer receiving surface of said middle segment; and a pinion, rotatably connected on a side of said lower segment adjacent to said first ring gear and said half-ring gear, comprises a bevel gear for driving said first gear and said half-ring gear.

28. A firefighting monitor as recited in claim 17 wherein:

(a) said predetermined curvature of said lower segment of said conduit comprises a curvature of approximately 68 degrees;

(b) said predetermined curvature of said middle segment of said conduit comprises a curvature of approximately 34 degrees;

(c) said first curvature extending a predetermined distance from an inlet end of said upper segment of said conduit comprises a curvature of approximately 73 degrees; and (d) said second curvature of said upper segment, extending over a predetermined distance from said first curvature distance to an outlet end, comprises a curvature of approximately 39 degrees.

29. A firefighting monitor for redirecting a flow of fluid from a pressurized fluid source through a segmented conduit comprising:

a stationary segment connected to said fluid source;

a lower segment of said conduit having a predetermined curvature between an inlet end and an outlet end, said inlet end being rotatably connected to said stationary segment, said lower segment including means for enabling azimuth rotation of said monitor;

a middle segment of said conduit having a predetermined curvature between an inlet end and an outlet end;

means for connecting said middle segment to said lower segment wherein the middle segment rotates on said lower segment;

means for rotatably connecting a first ring gear on an inlet end of said middle segment, said rotatably connecting means provides for rotating said first ring gear on said middle segment;

an upper segment of said conduit having a first curvature extending a predetermined distance from an inlet end and a second curvature extending over a predetermined distance from the end of said first curvature distance to an outlet end of said upper segment;

a second ring gear connected on an inlet end of said upper segment;

means for connecting said upper segment to said middle segment wherein said upper segment rotates on said middle segment and said second ring gear connected to said upper segment engages with said first ring gear;

a half-ring gear, attached to a predetermined outside surface of said middle segment;

means, positioned adjacent to said middle segment and extending from a housing on a side of said lower segment, for driving said half-ring gear and said first ring gear in counter rotating directions; and means, coupled to said means for driving said half-ring gear and said first ring gear, for adjusting an elevation discharge position of said monitor.

30. The firefighting monitor as recited in claim 29 wherein said azimuth rotation means comprises an azimuth shaft assembly connected to a first turning device.

31. The firefighting monitor as recited in claim 29 wherein said predetermined curvature of said lower segment of said conduit comprises a curvature of approximately 68 degrees.

32. The firefighting monitor as recited in claim 29 wherein said predetermined curvature of said middle segment of said conduit comprises a curvature of approximately 34 degrees.

33. The firefighting monitor as recited in claim 29 wherein said means for rotatably connecting said middle segment to said lower segment comprises a male/female ball race.

34. The firefighting monitor as recited in claim 29 wherein said rotatably connecting means for rotating said first ring gear on said middle segment comprises a male/female ball race.

35. The firefighting monitor as recited in claim 29 wherein said first curvature extending a predetermined distance from an inlet end of said upper segment of said conduit comprises a curvature of approximately 73 degrees.

36. The firefighting monitor as recited in claim 29 wherein said second curvature of said upper segment extending over a predetermined distance from the end of said first curvature distance to an outlet end comprises a curvature of approximately 39 degrees.

37. The firefighting monitor as recited in claim 29 wherein said means for rotatably connecting said upper segment to said middle segment comprises a male/female race.

38. The firefighting monitor as recited in claim 29 wherein said means for driving said half-ring gear and said first ring gear in counter rotating directions simultaneously comprises a bevel gear of a pinion.

39. The firefighting monitor as recited in claim 29 wherein said means for adjusting said elevation discharge position of said monitor comprises an elevation shaft assembly connected to a second turning device.

40. The firefighting monitor as recited in claim 29 wherein said first ring gear and said second ring gear engage each other at an angle of approximately 34 degrees.

41. The firefighting monitor as recited in claim 29 wherein:

(a) said predetermined curvature of said lower segment of said conduit comprises a curvature of approximately 68 degrees;

(b) said predetermined curvature of said middle segment of said conduit comprises a curvature of approximately 34 degrees;

(c) said first curvature extending a predetermined distance from an inlet end of said upper segment of said conduit comprises a curvature of approximately 73 degrees; and (d) said second curvature of said upper segment, extending over a predetermined distance from the end of said first curvature to an outlet end, comprises a curvature of approximately 39 degrees.

42. A method of providing a firefighting monitor for redirecting a flow of fluid from a pressurized fluid source through a conduit comprising the steps of:

providing a conduit having four consecutive segments rotatably connected in series wherein an axis of rotation is provided at each connection between said four segments;

connecting a first segment to said fluid source followed in series by connecting a second segment to an outlet of said first segment, connecting a third segment to an outlet of said second segment and connecting a fourth segment to an outlet of said third segment forming consecutively at each connection a first axis of rotation, a second axis of rotation and a third axis of rotation respectively;

redirecting an azimuth angle of said conduit by rotating said second segment around said first segment on said first axis of rotation;

redirecting an elevation angle of said conduit by rotating said second segment and said third segment on said second axis of rotation in a second rotation direction, and by rotating said third segment and said fourth segment on said third axis of rotation in an opposite direction to said second rotation direction; and synchronizing said second rotation between said second segment and said third segment and said third rotation between said third segment and said fourth segment in counter rotating directions to obtain approximately planar motion of said discharge centerline during said elevation angle redirection.

43. The method as recited in claim 42 wherein said method comprises the step of intersecting a discharge centerline of a discharge end of said fourth segment with a centerline of said third axis of rotation of said third segment and a centerline of said second axis of rotation of said second segment, thereby minimizing rotational torque on the connection between said second segment and said third segment and the connection between said third segment and said fourth segment.

* * * * *